United States Patent [19]

Cruz

[11] Patent Number: 4,932,591

[45] Date of Patent: Jun. 12, 1990

[54] PULVERIZER, FLUID

[76] Inventor: Luis R. Cruz, Roosevelt 2246-2PB, Buenos Aires (1428), Argentina

[21] Appl. No.: 170,854

[22] Filed: Mar. 21, 1988

[51] Int. Cl.[5] ..... B05B 1/26

[52] U.S. Cl. ..... 239/498; 239/514; 239/518

[58] Field of Search ..... 239/498, 500, 512, 514, 239/518, 524

[56] References Cited

U.S. PATENT DOCUMENTS

| | | | |
|---|---|---|---|
| 603,933 | 5/1898 | Weeks | 239/514 |
| 830,963 | 9/1906 | Bryan et al. | 239/524 |
| 937,507 | 10/1909 | Bryan et al. | 239/514 |
| 1,165,240 | 12/1915 | Gault et al. | 239/518 |
| 1,405,810 | 2/1922 | Wilkie | 239/498 |
| 1,876,669 | 9/1932 | Harlow | 239/524 |
| 2,712,962 | 7/1955 | Goddard | 239/498 |
| 2,994,484 | 8/1961 | Stearns | 239/498 |
| 3,141,000 | 7/1964 | Turner | 239/518 |
| 4,229,388 | 10/1980 | Lignell | 239/524 |

FOREIGN PATENT DOCUMENTS

| | | | |
|---|---|---|---|
| 814534 | 9/1951 | Fed. Rep. of Germany | 239/514 |
| 431676 | 9/1911 | France | 239/514 |
| 55644 | 5/1967 | German Democratic Rep. | 239/518 |
| 141641 | 8/1953 | Sweden | 239/514 |
| 535451 | 4/1941 | United Kingdom | 239/514 |

*Primary Examiner*—Robert J. Oberleitner
*Assistant Examiner*—Michael J. Forman
*Attorney, Agent, or Firm*—Malin, Haley, McHale, DiMaggio & Crosby

[57] ABSTRACT

The invention relates to a fluid nozzle wherein the formation of eddy currents is reduced to a minimum in the area of laminar flow and the velocity of the fluid is increased to a maximum. This is accomplished by the use of a convergent nozzle wherein the fluid is accelerated and pressure is decreased, then directed over an atomizing body having a convex outer surface where the fluid is allowed to expand and increase its velocity with a further reduction in pressure. Protrusions in the form of a plate or other projections extend from the surface of the convex outer surface to produce fluid flow detachment, separation and high velocity fluid spraying. Adjustment means are provided whereby the axial distance between the nozzle orifice and the atomizing body can be varied according to the desired fluid flow patterns.

4 Claims, 2 Drawing Sheets

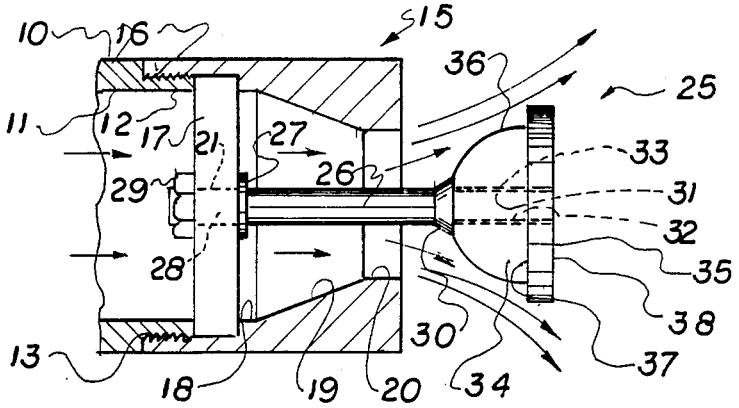
FIG. 1
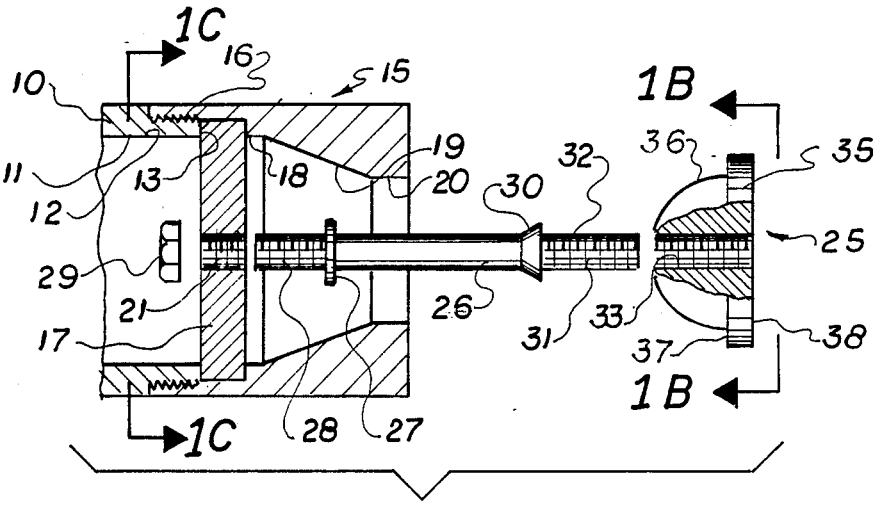
FIG. 1A FIG. 1B
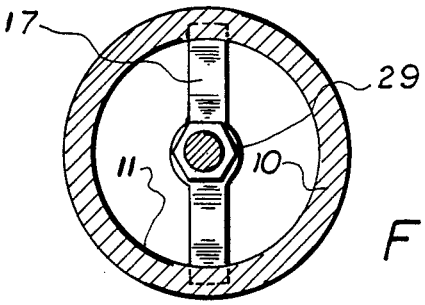
FIG. 1C
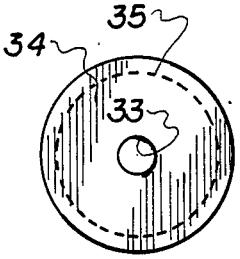
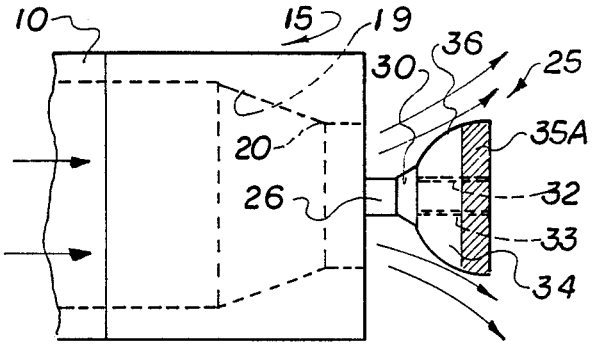
FIG. 2
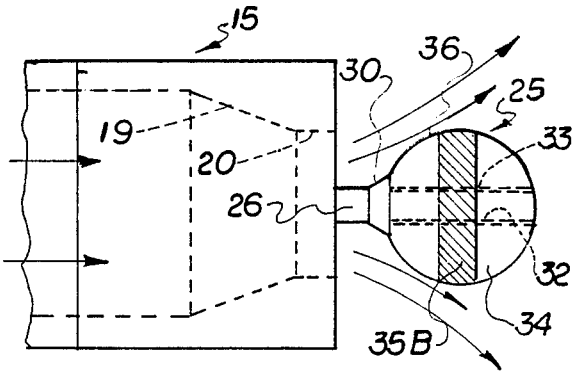
FIG. 3

PULVERIZER, FLUID

BACKGROUND OF THE INVENTION

The present invention relates generally to fluid nozzles and more particularly to fluid nozzles for discharging fluid at an extremely high velocity and at a minimum pressure wherein the fluid is atomized to its maximum.

Fluid nozzles, per se, are old and well known. However, due to the almost unlimited number of uses for efficient fluid nozzles there is always creative activity in this area attempting to find the ultimate nozzle. As indicated above, fluid nozzles are found in many diverse fields of endeavor. For example, fluid nozzles are used in water cooling, aerating, irrigating, spraying and spray drying systems. Fluid nozzles also find many applications in earth boring, drilling, and surface erosion by cavitation. None of these known types of nozzles provide any secondary means of further increasing the velocity of the fluid once it has left the discharge orifice of the nozzle. It is this deficiency of the prior art nozzles that forms the basis for the instant application.

SUMMARY OF THE INVENTION

The instant invention relates to an improved nozzle wherein the nozzle is provided with a tubular section of large cross-section for receiving fluid under pressure, which can be low, medium or high pressure, followed by a convergent portion wherein the velocity of the fluid is accelerated prior to its exiting through an orifice of lesser diameter than the aforementioned tubular section. The fluid exits through the nozzle orifice continues to the longitudinal axis of the nozzle. Atomizing means, for further increasing the velocity of the fluid are provided downstream of the nozzle discharge orifice. This atomizing means can take one of several forms, i.e., the form of a sphere, semi-sphere, ellipsoid or semi-ellipsoid. Each of these body shapes intially presents a smooth convex outer surface for the fluid to impinge upon. As the fluid strikes the atomizing means the velocity of the fluid is further increased and the pressure of the fluid is further decreased. Various surface variances may be provided on the outer surface of the atomizing means to improve fluid separation, turbulence and spraying. Adjustment means are provided whereby the axial distance between the nozzle orifice and atomizing means can be varied according to the desired fluid flow patterns.

OBJECTS OF THE INVENTION

An object of the invention is to provide a fluid nozzle having a first and second means for increasing fluid velocity and decreasing fluid pressure.

A further object of the invention is the provision of atomizing means external of the nozzle having a smooth outer surface portion to provide uninterrupted fluid flow.

A still further object of the invention is the provision of multiple surface variances to induce fluid separation, turbulence and spraying effects.

Yet another object of the invention is the provision of adjustment means for positioning the fluid atomizing means.

Another object of the invention is the provision of adjustment means whereby the axial distance between the nozzle orifice and the atomizing means can be varied to avoid blockage of the fluid flow coming from the nozzle.

A further object of the invention is the provision of fluid atomizing means in the form of a sphere, semi-sphere, ellipsoid or semi-ellipsoid.

A still further object of the invention is the provision of a circular plate in combination with the semi-spherical fluid atomizer.

A further object of the invention is the provision of a nozzle and fluid atomizer which can be used with low, medium and high pressure fluids.

Yet another object of the invention is the provision of control atomizing flow means, to meet flow pattern requirements, i.e. diameter of the sphere and semi-sphere; ratio of axial distance of ellipsoid and semi-ellipsoid; and distribution of the surface variances over the atomizing means and also their shapes.

These and other objects of the instant invention will become more apparent hereinafter, the instant invention will now be described with particular reference to the accompanying drawings which form a part of this specification wherein like reference characters designate the corresponding parts in the several views.

BRIEF DESCRIPTION OF THE DRAWINGS

FIG. 1 is a cross-sectional view of a fluid nozzle provided with a semi-spherical atomizing spray control body.

FIG. 1A is an enlarged exploded view illustrating the components of FIG. 1.

FIG. 1B is an end view taken along the section line 1B—1B of FIG. 1A.

FIG. 1C is a sectional view taken along the section lines 1C—1C of FIG. 1A.

FIG. 2 is a side view of a fluid nozzle provided with another embodiment of the semi-spherical atomizing spray control body.

FIG. 3 is a side view of a fluid nozzle provided with a spherical atomizing spray control body.

DETAILED DESCRIPTION OF THE DRAWINGS

Figure 4:
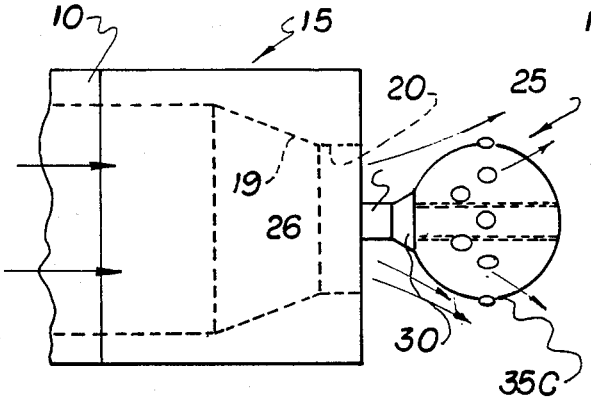
FIG. 4 is a side view of a fluid nozzle provided with another embodiment of the spherical atomizing spray control body.

Referring now to FIG. 1, there is shown in cross-section a conduit 10 having an internal diameter 11 of constant cross-section. Conduit 10 is provided with threads 12 and terminates with a front face 13. Threadably received by conduit 10 is nozzle head 15 by means of threaded portion 16. Threaded portion 16 of nozzle head 15 first receives radial support 17 prior to its being threaded onto conduit 10. Nozzle head 15 is further provided with a first cylindrical portion 18 which is immediately followed by convergent portion 19 which terminates with nozzle orifice 20 through which the fluid exits in a straight line approximately parallel to the central axis of the nozzle head 15. Radial support 17 is provided with a threaded central bore 21 which receives outermost end 28 of stem 26. Stem portion 26 is provided with an annular flange 27 at the base of threaded outermost end 28. Threaded outermost end 28 is sufficiently long to protrude through central bore 21 sufficiently to permit nut 29 to be threaded thereon to securely mount stem 26 to radial support 17. The opposite end of stem 26 is provided with an annular expanding flange 30 forming a shoulder thereon. Outward of flange 30 opposite end portion 31 of stem 16 is provided with external threads 32 which cooperate with internal threads 33 of atomozing control body 34. Integral with atomizing control body 34 is an annular flange 35 which projects uniformly beyond spherical outer surface 36. Annular flange 35 is provided with two parallel faces 37 and 38. The thickness and diameter "d" of annular flange 35 may be varied according to operational requirements.

Having set forth the structure of one of the several disclosed embodiments, the theory of operation of the device will now be explained as follows:

Fluid is flowing in conduit 10 a indicated by the arrows. A significant advantage of the instant invention is the fact that the fluid may be at low, medium or high pressure. As the fluid is about to exit conduit 10 it travels through the openings between the radial arms of radial support 17 and continues through the short cylindrical portion 18 into the convergent portion 19 of nozzle head 15. As the fluid passes through convergent portion 19 the velocity of the fluid is accelerated and the pressure is reduced then exits the nozzle head 15 through nozzle orifice 20 which is substantially reduced in diameter compared to the internal diameter of conduit 10. As the fluid exits through nozzle orifice 20, it is travelling parallel to the longitudinal axis of the entire assembly. As the fluid approaches atomizing control body 34 it first contacts annular expanding flange 30. The direction of the fluid changes and is directed outwardly from the central axis as it continues to flow around control body 34 with a radial component due to contact with spherical outer surface 36 of atomizing control body 34. As a result of the convex configuration of main control body 34 the velocity of the fluid is further increased as it passes over main body 34 and the static local pressure of the fluid is simultaneously decreased to its minimum thus making the fluid flow very sensitive and responsive to any disturbances over the outer surface 36 of main control body 34. As the fluid continues its flow over atomizing control body 34 it contacts annular flange 35 which creates maximum turbulence of the fluid thus causing separation and detachment of the fluid from spherical outer surface 36 of atomizing control body 34 into a spray pattern as indicated by the arrows.

FIG. 1A is an enlarged exploded view of the structure illustrated in FIG. 1 thus providing a clearer showing of how the various components are interconnected to provide the operative structure of FIG. 1.

FIG. 1B is an end view of the atomizing control body 34 of FIG. 1A and also a showing of annular flange 35 which initiates separation of the fluid from convex outer surface 36.

FIG. 1C is a cross-sectional view taken along the line 1C—1C of FIG. 1A. The main purpose of this view is to provide an illustration of radial support 17 and its mounting relative to conduit 10 and nozzle head 15.

Referring now to FIG. 2 wherein a second embodiment of atomizing control body 34 is shown. Here also, main control body 34 is spherical in configuration and the various components of nozzle head 15 and radial support 16 are the same as previously set forth relative to FIG. 1, therefore, they have not been repeated. As shown in FIG. 1, stem 26 projects out beyond nozzle orifice 20 and serves as supporting means for atomizing control body 34. As in FIG. 1, control body 34 is hemispherical in configuration, i.e. approximately half of a sphere. A certain percent of the hemisphere, the area of maximum diameter, is provided with surface variances as shown at 35. Spherical outer surface is smooth and uninterrupted up to the point of surface variances of smoothness 35A. Surface variances of smoothness 35A comprise diagonal grooves which are cut into outer spherical surface 36. These surface variances of smoothness 35A produce disturbances in the fluid flow which initiates fluid separation and spraying as indicated by the arrows. Outer end 31 of stem 26 is provided with external threads 33 of atomizing control body to provide support thereto. In addition, threads 32 and 33 provide for limited axial adjustment of atomizer control body 34 relative to nozzle orifice 20 whereby the spraying pattern may be varied depending upon the operational requirements.

Referring now to FIG. 3, wherein another embodient of the atomizing control body 34 is illustrated in the form of a sphere having a centrally located band of diagonal grooves, surface variances smoothness 35B in its outer spherical surface 36. Atomizing control body 34 is also axially adjustable by means of cooperating threads 32 and 33 in the same manner as FIG. 2.

Referring now to FIG. 4 wherein another embodiment of a spherical atomizing control body 34 is illustrated as having rounded projections 35C which serve as surface variances of curvature on the spherical outer surface 36 with a circumferential row of larger rounded projections 35C located at approximately the mid-point of atomizing control body 34. Located upstream of larger rounded projections 35C is a second row of lesser diameter projections 35C. Additionally, atomizing control body 34 can be adjusted axially relative to nozzle orifice 20.

Figure 5:
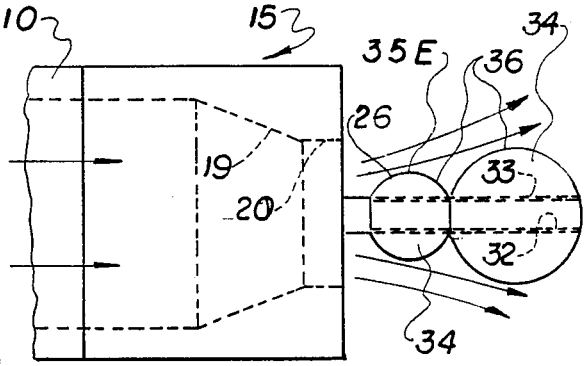
FIG. 5 is a side view of a fluid nozzle with a further embodiment of a spherical atomizing spray control body.

Referring to FIG. 5 there is shown a further embodiment utilizing a pair of spherical atomizing control bodies 34. Outer surfaces 36 are both smooth, however, upstream control body 34 is of lesser diameter than downstream control body 34. In this embodiment, the smaller body 34 is first contacted by the fluid flow and separates the fluid in preparation for its subsequent contact with larger diameter atomizing control body 34. The ratio of diameters selected is a function of the fluid flow parameters and the desired spraying pattern. Both control bodies 34 are axially adjustable relative to nozzle orifice 20.

Figure 6:
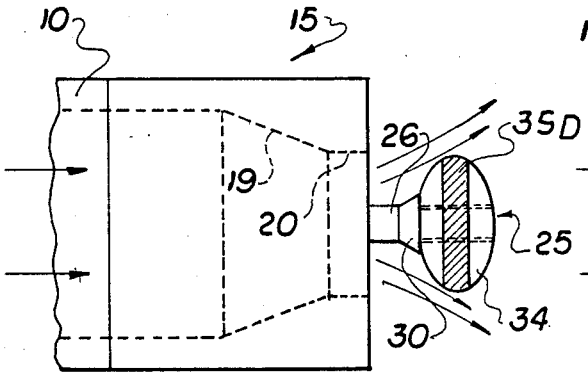
FIG. 6 is a side view of a fluid nozzle provided with an elliptical atomizing spray control body.

Referring now to FIG. 6, there is shown an atomizing control body 34 in the shape of an ellipsoid. Here also, there is a centrally located band of surface variances of curvature 35D in the form of knurling. An integral expanding flange 30 is provided on stem 26 immediately upstream of atomizing control body 34 to make fluid contact with control body 34 less abrupt.

Figure 7:
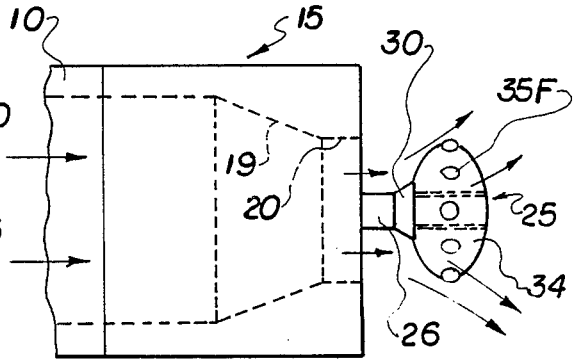
FIG. 7 is a side view of a fluid nozzle provided with a further embodiment of an elliptical atomizing spray control body.

Referring to FIG. 7, there is shown a further embodiment of an elliptical atomizing control body 34 which is provided with a row of raised projections 35F surface variances of curvature about its major axis.

Figure 8:
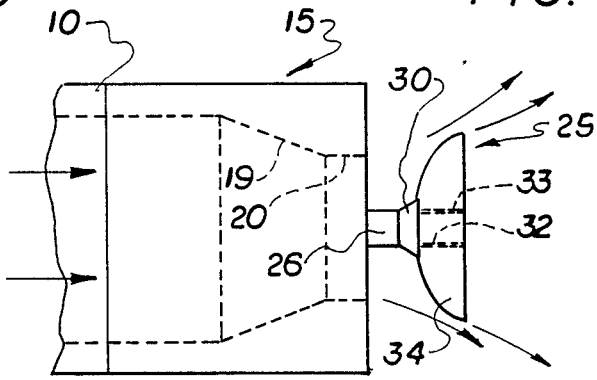
FIG. 8 is a side view of a fluid nozzle provided with a semi-ellipsoidal atomizing spray control body.

FIG. 8 is an illustration of a smooth semi-ellipsoid used as the atomizing control body 34. Threads 32 and 33 cooperate to provide axial adjustability of atomizing control body 34 relative to nozzle orifice 20.

It is to be noted and understood that all embodiments of atomizing control body 34 present a convex surface directed upstream toward the oncoming fluid flow. It is this convex surface and its distance relative to nozzle orifice 20 which imparts an additional velocity increase and pressure decrease to the flowing fluid.

Although the surface variances have mostly taken the form of protuberances from the outer surface of atomizing control body 34, the surface variances may also take the form of various patterns of recesses or depressions, both circular and elongate, in the outer surface 36. Additionally, a deflector in the form of a circular wall extending outward from the end face of nozzle head 15 in the direction of atomizing control body 34 to confine the fluid as it approaches atomizing control body 34 may be provided.

It is also to be noted that stem 26 and atomizing spray control body 25 may be made integral rather than separate components. If this were done, the axial distance of control body 25 from the nozzle orifice 20 would be varied by the threaded end 28 of stem 26.

Additionally, ellipsoidal control bodies may have their minor axis perpendicular to the longitudinal axis of stem 26, depending on the specific flow requirements or application of the device.

While the invention has been described in its preferred embodiments, it is to be understood that words which have been used are words of description rather than limitation and that changes may be made within the purview of the appended claims without departing from the full scope or spirit of the invention.

Having thus described my invention, I claim:

1. A fluid pulverizer comprising:

(a) a converging fluid nozzle means having a threaded upstream end portion, a converging intermediate portion, and a downstream end portion; said threaded upstream end portion being connected in fluid flow relation to a fluid flow means for providing a flow of fluid under pressure to said converging fluid nozzle means; said downstream end portion terminating in an end wall defining an exit orifice therethrough; said converging fluid nozzle means functioning by simultaneously increasing the velocity and decreasing the pressure of fluid flowing therethrough; said converging fluid nozzle means further including a cylindrical portion located between said threaded upstream end portion and said converging intermediate portion;

(b) an atomizing body means located external to said converging fluid nozzle means comprising a smooth, convexly curved outer surface whereby said atomizing body means has attached thereto a detachment means; said atomizing body means having a widest periphery defining a plane generally normal to a line connecting said upstream and downstream end portions; said detachment means is formed by a band of plural surface variances disposed about the widest periphery of said atomizing body means, said detachment means is formed on said atomizing body means for initiating turbulence, separation, and spraying of fluid from said fluid flow means at a high velocity;

(c) a support means projecting from said converging fluid nozzle means in a downstream direction fixedly, yet longitudinally adjustably connecting said converging fluid nozzle means with said atomizing body means; said support means comprises a radial arm extending across said cylindrical portion of said converging fluid nozzle means, said radial arm having a centrally located bore therein, said support means further comprises a support stem having a longitudinal axis coinciding with said line connecting the upstream and downstream end portions and threadably received in said centrally located bore with said support stem extending through said exit orifice and projecting therebeyond, said support stem also provided with threads on its free end which projects through said exit orifice for receiving said atomizing body means.

2. A fluid pulverizer of claim 1 wherein said atomizing body means is an ellipsoid.

3. A fluid pulverizer of claim 1 wherein said atomizing body means is a semi-ellipsoid.

4. A fluid pulverizer of claim 1 wherein said atomizing body means is a smooth sphere.

* * * * *